United States Patent [19]

Lundberg

[11] 4,193,276

[45] Mar. 18, 1980

[54] LOCK FOR RAILROAD SWITCH

[75] Inventor: George A. Lundberg, Kinnelon, N.J.

[73] Assignee: E. J. Brooks Company, Newark, N.J.

[21] Appl. No.: 941,913

[22] Filed: Sep. 13, 1978

[51] Int. Cl.[2] ..... E05B 67/36

[52] U.S. Cl. ..... 70/34; 70/409

[58] Field of Search ..... 70/32, 33, 34, 386, 70/402, 404, 407, 409

[56] References Cited

U.S. PATENT DOCUMENTS

| | | | |
|---|---|---|---|
| 1,978,781 | 10/1934 | Berger | 70/404 |
| 1,994,095 | 3/1935 | Caldwell | 70/404 |
| 3,914,965 | 10/1975 | Paxton | 70/34 |
| 4,152,909 | 5/1979 | Lundberg | 70/34 |

FOREIGN PATENT DOCUMENTS

| | | | |
|---|---|---|---|
| 449281 | 7/1949 | Italy | 70/34 |

*Primary Examiner*—Robert L. Wolfe
*Attorney, Agent, or Firm*—Robert E. Ross

[57] ABSTRACT

A lock for a railroad switch or the like, which comprises a housing having a socket at one end and an elongated shackle having an enlargement on one end and a recess on the other end for cooperating with locking members in the housing so as to be received in locking engagement therein. The operating member for the locking member is a rotatable and axially movable plunger. Springs are provided to bias the plunger in rotation to the locking position and forwardly. Pin and groove guide means is provided to maintain the plunger in the unlocking position and to allow the plunger to rotate to the locking position when the plunger is moved axially by insertion of the end of the shackle into the housing.

5 Claims, 5 Drawing Figures

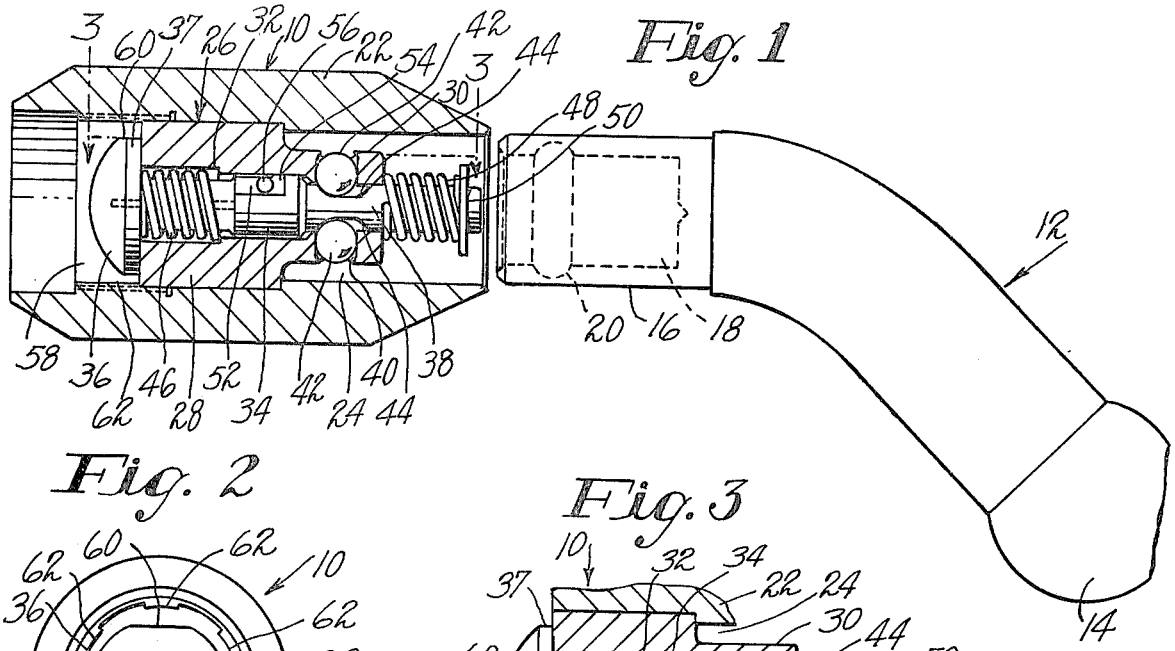
Fig. 1
Fig. 2
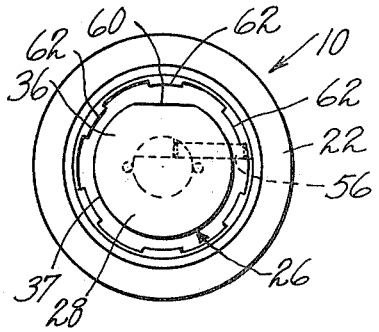
Fig. 3
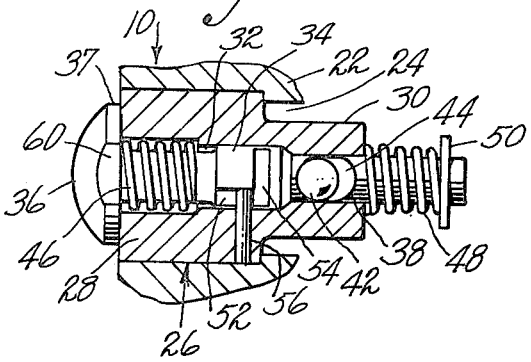
Fig. 4
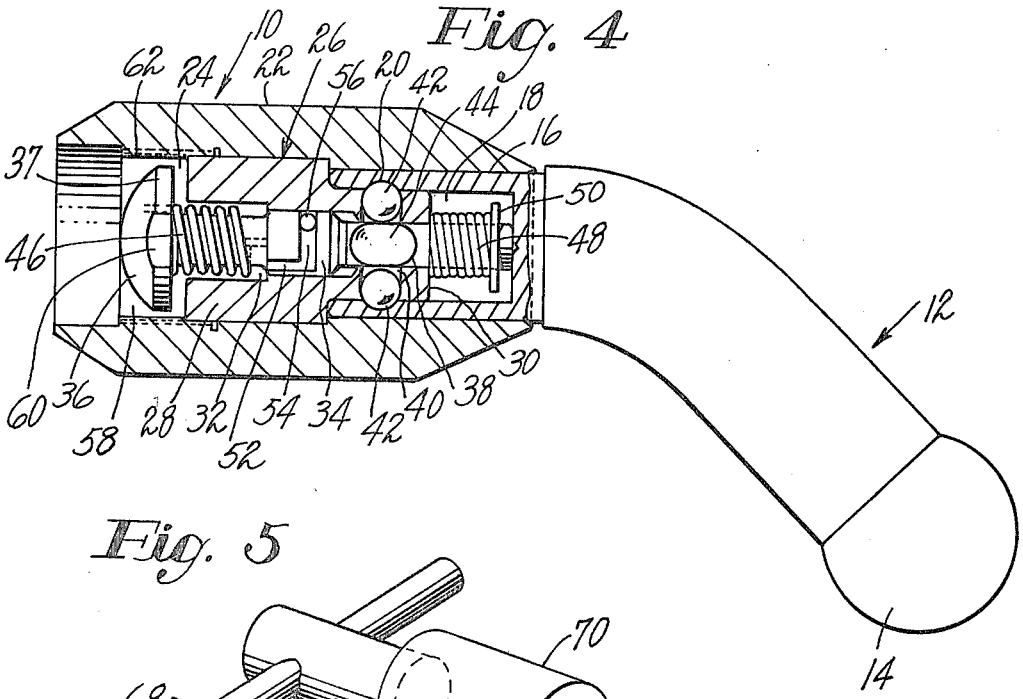
Fig. 5
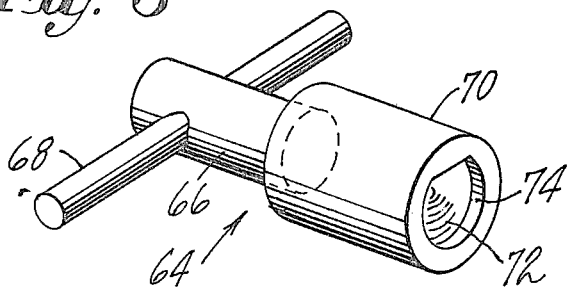

LOCK FOR RAILROAD SWITCH

BACKGROUND OF THE INVENTION

In my application Ser. No. 803,796 there is described a lock especially designed for use on railroad switches to reduch acts of vandalism. The losk disclosed therein comprises a housing adapted to receive an end of a shackle in locking engagement. The lock is operated by rotation of a shaft, which is biased to the locking position. Hence to assemble the shackle with the housing, it is necessary to rotate the shaft to the unlocking position with a suitable tool, insert the shackle, and release the tool. This operation has been found difficult to accomplish under service conditions.

SUMMARY OF THE INVENTION

This invention provides a lock as described in the above identified patent application and hereinbefore in which the shaft and housing have cooperating pin and groove means to maintain the shaft in the unlocking condition when in one axial position and to allow it to rotate to the locking under the force of a biasing spring when moved to a second axial position. Spring means is also provided to bias the shaft to said one axial position. Cooperating means is also provided on the shaft and shackle so that when the shackle is inserted into the housing, the shaft is moved axially by the shackle to said other position wherein the pin and groove allow the shaft to rotate to the locking position.

This structure has the advantage of allowing the shackle to be assembled into the housing without the use of the operating tool.

BRIEF DESCRIPTION OF THE FIGURES OF THE DRAWING

FIG. 1 is a view in side elevation, partly in section, of a lock embodying the features of the invention, including a housing and a shackle for assembly with the housing.

FIG. 2 is a view of the housing of FIG. 1 as seen from the left end.

FIG. 3 is a view taken on line 3—3 of FIG. 1.

FIG. 4 is a view similar to FIG. 1 in which the shackle has been assembled into the housing.

FIG. 5 is a perspective view of a tool for use in opening the lock.

DESCRIPTION OF THE ILLUSTRATED EMBODIMENT

Referring to the drawing, there is illustrated a lock for assembly into suitable aligned apertures in an operating mechanism of a device such as railroad switch or the like (not shown), said lock comprising a housing 10 and a shackle 12 adapted for locking engagement.

The shackle 12 may have any desired shape, such as being curved in the manner of a padlock shackle, or may be straight, depending on the particular application in which it is to be used. The shackle 12 is generally of uniform diameter throughout its length, except for an enlarged knob 14 on one end and a reduced portion 16 on the other end. Said other end has an opening 18 with an internal peripheral recess 20 spaced inwardly from the opening entrance a predetermined distance.

The housing 10 comprises an outer member 22 having an opening 24 extending therethrough, and a locking mechanism 26 press fitted or otherwise retained in the housing, so that each end of the locking mechanism is spaced inwardly from the adjacent end of the housing.

The locking mechanism comprises an outer stationary housing 28 having a reduced end portion 30 and an internal opening 32, and a rotatable operating member 34 disposed in the opening 32. The operating member 34 has an enlarged head 36 with a peripheral rim 37 disposed on one end thereof outside the locking mechanism housing 28 and within the housing 10, and a forwardly projecting ball positioning member 38 extending into the reduced end portion 30.

The reduced end portion 30 is provided with a pair of side apertures 40 for carrying locking balls 42 each of which is retained between a restricted portion of the openings at the surface of the end portion 30 and the ball positioning member 38.

The ball positioning member 38 is provided with a pair of shallow recesses 44 disposed 180° apart, and the ball positioning member, the locking balls and the end portion 30 of the locking mechanism housing 28 are so dimensioned that when the operating member 34 is rotated to the un-locking position, the balls 42 seat in the recess 44, and the outer surface of each ball is substantially at the surface of the reduced end portion 30 of the locking mechanism housing, so that the end 16 of the shackle can be inserted into the adjacent end of the housing 10, with the reduced end portion 30 of the locking mechanism housing entering the opening 18 in the shackle, the balls 42 thereby being positioned opposite the peripheral recess 20 of the shackle.

Thereafter rotation of the operating member 34 to the locking position will cause the balls 42 to be cammed outwardly on the surface of the ball positioning member so that the outer surface of the balls project into the shackle recess 20, preventing removal of the shackle from the housing.

The above described portion of the device is similar to that disclosed in the above identified application Ser. No. 803,796.

In the embodiment illustrated herein the motion of the operating member 34 is controlled by:

(a) a spring 46 which is connected between the operating member 34 and the locking mechanism housing so as to bias the operating member in rotation in the closkwise direction as seen from the left end;

(b) a spring 48 connected between an end plate 50 secured to the end of the operating member 34 and the locking mechanism housing so as to bias the operating member 34 to the right as seen in FIG. 1;

(c) a groove formed in the surface of the operating member, said groove having a longitudinal portion 52 and a radial portion 54 extending counter-clockwise (as seen from the left end) from the right end of the longitudinal groove; and (d) a pin 56 rigidly mounted in the locking member housing and having an end protruding therefrom into the groove.

When the device is in the un-locked and dis-assembled condition as seen in FIGS. 1–3, the operating member 34 is so oriented in the locking mechanism housing 28 that the recesses 44 are aligned with the ball apertures 40, so that the balls can retract below the surface of the reduced end portion 30.

Although the spring 46 is biasing the operating member 34 in the clockwise direction, the operating member is prevented from rotating to the locking orientation by the pin 56, which is protruding into the longitudinal portion 56 of the groove. The spring 48, in biasing the operating member 34 to the right, maintains the pin 56 in the longitudinal portion of the groove.

When it is desired to assemble the lock with a device to be protected, the end of the shackle 12 having the reduced end portion 16 is passed through the apertures in aligned portions of the device, such as a switch operating mechanism (not shown) that would otherwise receive the shackle of a padlock, and the reduced portion 16 of the shackle is inserted into the opening 24 of the housing 10, until the peripheral groove 20 is opposite the balls 42.

The dimensions of the components are such that as the shackle end approaches this position, the end of the operating member 34 bottoms in the shackle aperture 18. Further movement of the shackle into the opening 24 causes the shackle to push the operating member 34 to the left so that the radial portion 54 of the groove becomes positioned in alignment with the pin 56. The biasing effect of the spring 46 then causes the operating member to rotate clockwise (as seen from the left end) so that the balls 42 are forced outwardly into the recess 20, thereby locking the shackle into the housing.

In the illustrated embodiment of the invention, the housing 10 extends a considerable distance beyond the head 36 forming a relatively deep cavity 58, the head 36 being disposed at the bottom of the cavity.

The periphery 35 of the head 36 is substantially circular, however it is sufficiently out of round to permit it to be rotated by a tool of corresponding shape. In the illustrated embodiment the out-of-roundness is provided by a flat portion 60, however the head may have other shapes, such as is illustrated in my above identified application Ser. No. 803,796.

The head 36 therefore has the appearance of a rivet, to disgiuse the fact that it is the means by which the lock is operated. This effect is enhanced by the fact that the head is in the bottom of the recess, and all surfaces inside the recess are painted a flat black.

To prevent unauthorized opening of the lock by a tool such as a screwdriver or the like, a series of projections 62 are provided on the interior surface of the housing around the head 36. Hence if an attempt is made to open the lock by inserting the end of a screwdriver into the space between the flat portion 60 of the head and the housing wall and moving the screwdriver radially to rotate the head, the presence of the projections 62 will prevent more than a few degrees of rotation.

To unlock the housing, the head 36 is rotated by a suitable tool 64 comprising a shaft 66 having a handle 68 at one end and a driving head 70 at the other end.

The driving head 70 has a recess 72 in the forward face thereof, said recess being bounded by a periphery 74 which has a configuration the same as that of the periphery 35 of the head 36, and the external diameter of the driving head is slightly less than the diameter of a circle drawn within the inner surfaces of the projections 62. The driving head 70 may therefore be inserted into the housing in the appropriate orientation so that the head 36 of the operating member enters the recess 72.

The tool may then be rotated counter-clockwise against the force of spring 46, so that the recesses 44 again become positioned opposite the balls 42 to allow removal of the shackle from the housing aperture 24. Such rotation for unlocking also positions the pin 56 in alignment with the longitudinal portion 52 of the groove, whereupon the spring 48 draws the operating member 34 to the right to its original position as shown in FIGS. 1–3, with the pin being disposed in the longitudinal portion of the groove to retain the operating member in the unlocked position.

I claim:

1. A lock assembly for releasably engaging a shackle end, comprising a housing having locking means at one end for engaging a shackle end and lock operating means comprising an elongated shaft rotatable between a locking orientation and an unlocking orientation, means retaining said shaft in the unlocking orientation and means biasing said shaft to the locking orientation, and means responsive to axial movement of the shaft in a predetermined direction to cause said shaft to rotate to the locking position.

2. A lock assembly as set out in claim 1 in which said shaft has an operating head on one end, the other end being positioned for contact with a portion of a shackle assembled with the lock assembly so that the shaft is moved longitudinally in said predetermined direction when said shaft is assembled, spring means biasing the shaft longitudinally in a direction opposite to said predetermined direction.

3. A lock assembly for releasably engaging an end of a shackle, comprising a housing having an aperture at one end for receiving a shackle end, locking means in said aperture for engaging an assembled shackle, and lock operating means comprising an elongated member extending axially through said housing, said member being rotatable between a first orientation in which it retains the locking means in the locking position and a second orientation in which the locking means is allowed to move to the un-locking position, first spring means biasing said shaft to the locking orientation, said shaft being movable axially between a first position in which shaft positioning means maintains the shaft in the unlocking orientation and a second position in which the shaft positioning means permits the first spring means to bias the shaft to the locking orientation, and second spring means biasing the shaft axially to the first position, a shaft end being positioned for engagement by the shackle when the shackle is assembled to move the shaft to the second position, whereby the shaft rotates to the first orientation to move the locking means to the locking position.

4. A lock assembly as set out in claim 3 in which said shaft positioning means comprises a pin on the housing and a groove on the shaft which receives an end of the pin, said groove having a portion extending axially of the shaft permitting axial movement of the shaft and a radial portion intersecting said axial portion so as to permit rotational movement of the shaft when the shaft moves longitudinally to a position such that the pin is opposite the radial portion, said position being the second position.

5. A lock and shackle assembly comprising a shackle having a cavity at one end with a peripheral recess in the interior surface of the recess, and a lock assembly comprising a housing and a locking mechanism disposed inside the housing, said mechanism including a shackle engaging member having radially movable locking members for entering the peripheral recess of the shackle end when in the locking condition, a rotatable shaft having an end portion positioned and dimensioned to force said locking members into the locking condition when in a first orientation and to allow said locking members to move to the unlocking condition when in another orientation, first spring means biasing said shaft in rotation toward the locking orientation, said shaft being axially movable between a first position in which shaft positioning means maintains the shaft in the non-locking orientation and a second position in which the shaft positioning means allows the first spring means to bias the shaft to the locking position, second spring means biasing the shaft axially to the first position, the components being so positioned and dimensioned that when the shackle end is inserted into the housing, the shaft is moved axially by the shackle from the first position to the second position to allow the shaft to be rotated by the first spring to the locking orientation.

* * * * *